US007934946B2

(12) United States Patent
Alejandro et al.

(10) Patent No.: US 7,934,946 B2
(45) Date of Patent: May 3, 2011

(54) MEDIA POWER PROTECTION SYSTEM AND METHOD

(75) Inventors: Ann N. Alejandro, Houston, TX (US); Brian D. Ryder, Tomball, TX (US); Jeffrey Kevin Jeansonne, Houston, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 7 days.

(21) Appl. No.: 12/150,130

(22) Filed: Apr. 25, 2008

(65) Prior Publication Data

US 2008/0233792 A1 Sep. 25, 2008

Related U.S. Application Data

(63) Continuation of application No. 11/261,017, filed on Oct. 28, 2005, now Pat. No. 7,381,096.

(51) Int. Cl.
*H01R 3/00* (2006.01)

(52) U.S. Cl. ..... 439/489

(58) Field of Classification Search ..... 439/489, 439/630, 639, 945; 710/62, 301–304; 235/441, 235/381; 361/764, 735
See application file for complete search history.

(56) References Cited

U.S. PATENT DOCUMENTS

| | | | | |
|---|---|---|---|---|
| 6,097,605 | A | 8/2000 | Klatt et al. | |
| 6,438,638 | B1 | 8/2002 | Jones et al. | |
| 6,684,283 | B1 * | 1/2004 | Harris et al. | 710/302 |
| 6,738,259 | B2 | 5/2004 | Le et al. | |
| 6,871,244 | B1 * | 3/2005 | Cahill et al. | 710/62 |
| 6,901,520 | B2 | 5/2005 | Odaohara et al. | |
| 6,970,964 | B2 | 11/2005 | Mowery et al. | |
| 7,066,386 | B2 | 6/2006 | Izumi | |
| 7,136,950 | B2 | 11/2006 | Mowery et al. | |
| 7,310,212 | B2 | 12/2007 | Chang et al. | |
| 7,365,454 | B2 * | 4/2008 | Morrow | 307/140 |
| 2003/0038177 | A1 * | 2/2003 | Morrow | 235/441 |
| 2003/0065867 | A1 | 4/2003 | Mowery et al. | |
| 2003/0082961 | A1 | 5/2003 | Mowery et al. | |
| 2004/0059860 | A1 | 3/2004 | Liu et al. | |
| 2004/0184246 | A1 | 9/2004 | Le et al. | |
| 2005/0036397 | A1 | 2/2005 | Yeh et al. | |
| 2005/0176304 | A1 * | 8/2005 | Yiu | 439/630 |
| 2005/0218228 | A1 | 10/2005 | Chang et al. | |
| 2005/0225950 | A1 | 10/2005 | Matsuda et al. | |
| 2006/0066727 | A1 | 3/2006 | Yamagishi | |

OTHER PUBLICATIONS

China Office Action dated Jan. 8, 2010, 5 pages.

* cited by examiner

*Primary Examiner* — Alexander Gilman

(57) ABSTRACT

A media power protection system comprises a media controller configured to detect a type of media card coupled to a multi-card connector, and a protection circuit configured to selectively enable at least one of a plurality of power supply interfaces of the multi-card connector based on the type of media card.

17 Claims, 1 Drawing Sheet

MEDIA POWER PROTECTION SYSTEM AND METHOD

RELATED APPLICATIONS

This application is a continuation of U.S. patent application Ser. No. 11/261,017, filed Oct. 28, 2005 now U.S. Pat. No. 7,381,096, entitled "MEDIA POWER PROTECTION SYSTEM AND METHOD", which is hereby incorporated by reference herein.

BACKGROUND OF THE INVENTION

Some computer devices, such as laptop or notebook computers, generally have a media card slot configured to accept and/or communicatively engage different types of media cards (e.g., a memory stick (MS) media card, a secure digital (SD) media card and/or an extreme digital (xD) media card). However, metallic and/or conductive coatings on the media card(s) casing cause a short condition of the multi-card connector in the media card slot.

BRIEF DESCRIPTION OF THE DRAWINGS

For a more complete understanding of the present invention and the advantages thereof, reference is now made to the following descriptions taken in connection with the accompanying drawings in which.

DETAILED DESCRIPTION OF THE DRAWINGS

Figure 1:
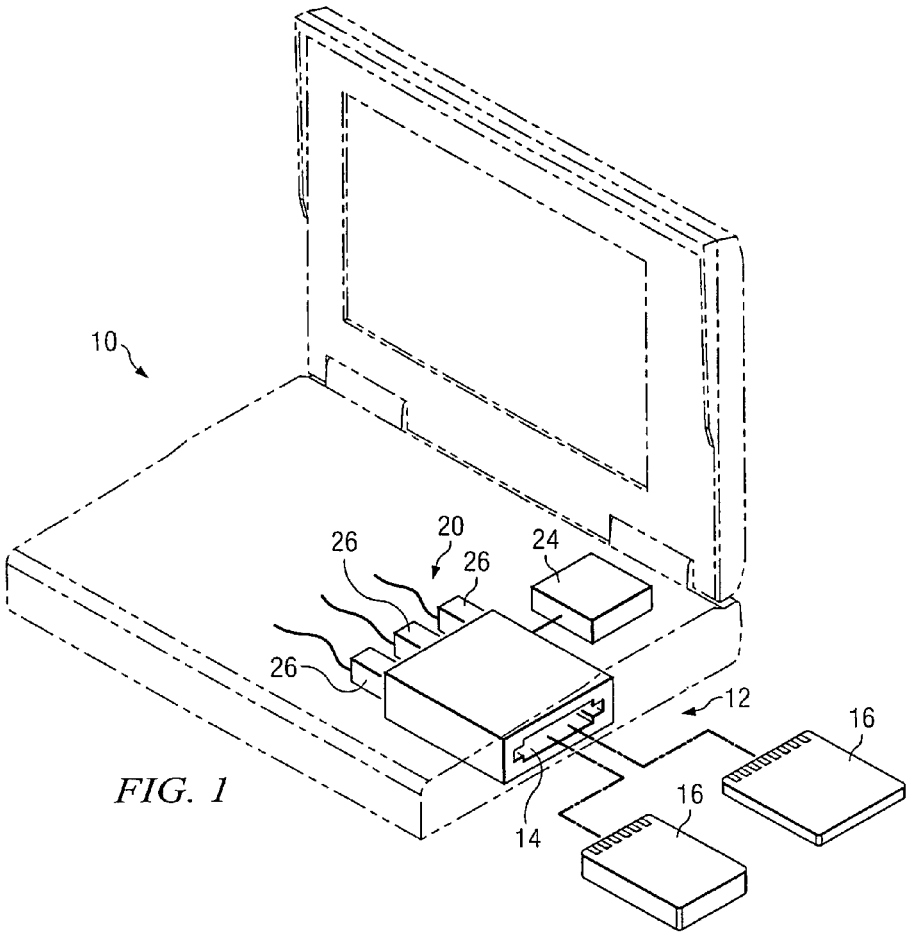
FIG. 1 is a diagram illustrating a computer device in which an embodiment of a power protection system in accordance with the present invention is employed to advantage.
Figure 2:
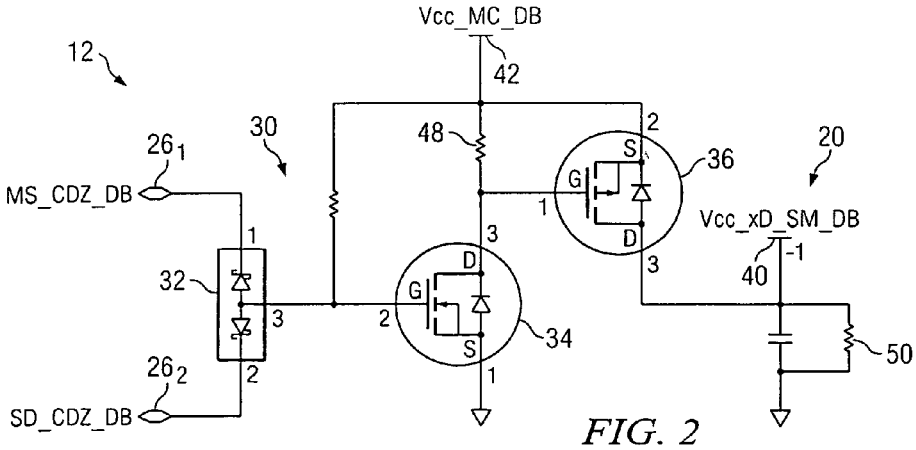
FIG. 2 is a diagram illustrating an embodiment of protection circuit of a power protection system in accordance with the present invention.

The preferred embodiments of the present invention and the advantages thereof are best understood by referring to FIGS. 1 and 2 of the drawings, like numerals being used for like and corresponding parts of the various drawings.

FIG. 1 is a diagram illustrating a computer device 10 in which an embodiment of a media power protection system 12 in accordance with the present invention is employed to advantage. In the embodiment illustrated in FIG. 1, computer device 10 comprises a laptop or notebook computer device. However, it should be understood that computer device 10 may comprise any type of computing device such as, but not limited to, a tablet computer, desktop computer, personal digital assistant, printer, copier, multi-function device, or other type of portable or non-portable computing device.

In the embodiment illustrated in FIG. 1, computer device 10 comprises a media card slot 14 for receiving different types of media cards 16 therein. For example, in the illustrated embodiment, computer device 10 comprises a multi-card connector 20 disposed within media card slot 14 configured to interface with and/or otherwise communicatively engage corresponding connector elements of different types of media cards 16. Multi-card connector 20 comprises contact pins for interfacing with the different types of media cards 16 (e.g., on the interior upper and lower sides of card slot 14). The different types of media cards 16 may comprise a memory stick (MS) type of media card 16, a secure digital (SD) type of media card 16, an extreme digital (xD) type of media card 16 and/or other types of media cards. Multi-card connector 20 is generally configured to communicatively engage such media cards 16 to provide an interface for power, ground, and data signal communication between computer device 10 and a particular media card 16 engaged therewith. Embodiments of the present invention enables/disables particular power supply interfaces of multi-card connector 20 for providing power to a particular media card 16 based on the type of media card 16 in engagement with multi-card connector 20, thereby isolating the power supply based on the type of media card 16.

In the embodiment illustrated in FIG. 1, computer device 10 comprises a media controller 24 which may comprise hardware, software, or a combination of hardware and software. Media controller 24 is communicatively coupled to multi-card connector 20 and is used to control data communications between computer device 10 and media card 16, power supply to media card 16, and detection of media cards 16 disposed within slot 14 and/or otherwise in engagement with multi-card connector 20. For example, multi-card connector 20 comprises identification pins 26 used to detect and/or otherwise identify a type of media card 16 inserted into slot 14 and into engagement with multi-card connector 20. In some embodiments of the present invention, identification pin(s) 26 comprise biased conductive element(s) configured to engage particular pin(s) or conductive element(s) of a particular media card 16 inserted into slot 14 and into engagement with multi-card connector 20. In response to contact of identification pin(s) 26 with the conductive pin(s) or element (s) of the particular media card 16, the identification pin(s) 26 is pulled to ground or LO. Media controller 24 detects the LO condition or state of identification pin(s) 26 and uses the detected LO signal to identify the engagement of media card 16. In some embodiments of the present invention, different combinations of identification pins 26 are used to identify different types of media card 16. For example, in some embodiments of the present invention, identification pins 26 are disposed at different locations on multi-card connector 20 such that different combinations of identification pins 26 are pulled to LO in response to different types of media cards 16 disposed in engagement with multi-card connector 20. As used herein, a combination of identification pins 26 includes a single pin 26 or a plurality of pins 26. Further, it should be understood that other devices and/or methods may be used to automatically identify a type of media card 16 inserted into card slot 14 and into engagement with multi-card connector 20.

FIG. 2 is a diagram illustrating an embodiment of a protection circuit 30 of media power protection system 12 in accordance with the present invention. Protection circuit 30 is used to enable/disable particular power supply interfaces 40 of multi-card connector 20 for providing power to a particular media card 16 based on the type of media card 16 in engagement with multi-card connector 20, thereby isolating the power supply based on the type of media card 16. For example, multi-card connector 20 comprises different power supply interfaces 40 for each type of media card 16 (e.g., different connector pins for coupling to different corresponding pins or elements on the particular media card 16). However, some media cards 16 have a conductive or metallic casing or coating. Thus, when such media cards are inserted into card slot 14 (FIG. 1), the casing or coating on such media cards 16 may contact other power supply interface 40 pins on multi-card connector 20, thereby causing a short condition. Embodiments of the present invention automatically identify the type of media card 16 in engagement with multi-card connector 20 and, based on the type of media card 16 in engagement with multi-card connector 20, selectively enables/disables particular power supply interfaces 40 of multi-card connector 20 (e.g., enable the power supply interface 40 for the engaged media card 16 and disable power supply interfaces 40 associated with other types of media cards 16).

In the embodiment illustrated in FIG. 2, circuit 30 is configured to selectively enable/disable a power supply interface 40 associated with a xD-type of media card 16 (indicated by VCC_xD_SM_DB in FIG. 2) based on whether either a MS-type or SD-type of media card is in engagement with multi-card connector 20. However, it should be understood that circuit 30 may be otherwise configured to selectively enable/disable power supply interfaces 40 associated with other types of media cards 16. Further, it should be understood that circuit 30 may be otherwise configured to selectively enable/disable power supply interfaces 40 based on detection signals associated with identifying other and/or additional types of media cards 16. Thus, in operation, in response to detecting engagement of a particular media card 16 with multi-card connector 20, media controller 24 (FIG. 1) detects the type of media card 16 in engagement with multi-card connector 20. In response to detecting the type of media card 16 in engagement with multi-card connector 20, the power supply (VCC_xD_SM_DB in FIG. 2) to power supply interfaces of the multi-card connector 20 are turned on and circuit 30 is used to enable the power supply interface for the particular type of media card 16 in engagement with multi-card connector 20 and disable power supply interfaces of multi-card connector 20 for other types of media cards 16.

In the illustrated example, circuit 30 comprises an AND gate 32, an N-channel field effect transistor (FET) 34, and a P-channel FET 36. In the embodiment illustrated in FIG. 2, AND gate 32 is configured to receive a detection signal indicating whether a particular type of media card 16 is in engagement with multi-card connector 20 (e.g., circuit 30 may be communicatively coupled to identification pins 26, receive a signal from media controller 24 (FIG. 1), or otherwise receive an indication of the type of media card 16 in engagement with multi-card connector 20). For example, in the embodiment illustrated in FIG. 2, one input (pin 1) of AND gate 32 is communicatively coupled to identification pin $\mathbf{26}_1$ for receiving a detection signal corresponding to a MS-type of media card 16 (indicated by MS_CDZ_DB in FIG. 2), and another input (pin 2) of AND gate 32 is communicatively coupled to identification pin 262 for receiving a signal or indication of engagement of a SD-type of media card 16 with multi-card connector 20 (indicated by SD_CDZ_DB in FIG. 2). Thus, in the illustrated example, circuit 30 is configured to receive a media card 16 detection signal corresponding to two different types of media cards 16. However, it should be understood that circuit 30 may be configured to receive media card 16 detection signals corresponding to a fewer or greater quantity of different media cards 16.

In the embodiment illustrated in FIG. 2, the output (pin 3) of AND gate 32 is coupled to the gate (pin 2) of FET 34, and the drain (pin 3) of FET 34 is coupled to the gate (pin 1) of FET 36. In the illustrated embodiment, the drain (pin 3) of FET 36 is coupled to power supply interface 40 of multi-card-connector 20 associated with the xD-type of media card 16. In FIG. 2, a single power supply interface 40 is illustrated (e.g., corresponding to an xD-type of media card 16). However, it should be understood that circuit 30 may comprise additional power supply interfaces 40 for additional and/or other types of media cards 16. In the illustrated embodiment, the source (pin 2) of FET 36 is coupled to a power supply 42 for providing power to the media card 16 in engagement with multi-card connector 20. Further, the source (pin 2) and gate (pin 1) of FET 36 are coupled to respective ends of a pull-up resistor 48. Accordingly, based on the detection signals indicating a type of media card 16 in engagement with multi-card connector 20, FETs 34 and 36 are effectively switched on/off to either enable or disable the power supply interface 40 for the xD-type of media card 16.

In the embodiment illustrated in FIG. 2, circuit 30 is configured to disable power supply interface 40 associated with the xD-type of media card 16 if either a MS-type or SD-type of media card 16 is in engagement with multi-card connector 20. For example, in the illustrated embodiment, in response to receiving a card detection signal indicating engagement of either an MS- or SD-type of media card 16 with multi-card connector 20, the output (pin 3) of AND gate 32 is pulled LO. In response to the LO output of AND gate 32, the input at the gate (pin 2) of FET 34 is LO and the drain (pin 3) of FET 34 is pulled to the value at resistor 48 (e.g., the power supply voltage indicated by VCC_MC_DB in FIG. 2). Thus, the input to the gate (pin 1) of FET 36 is HI and the drain (pin 3) of FET 36 is pulled to the value of a resistor 50 (ground), thereby disabling power supply interface 40 associated with providing power to pins or connector elements of multi-card connector 20 associated with an xD-type of media card 16.

Correspondingly, in response to detecting an absence of either an MS- or SD-type of media card 16 (e.g., the absence of a signal indicating the presence or engagement of either an MS- or SD-type of media card 16 with multi-card connector 20), the output (pin 3) of AND gate 32 is driven HI, thereby causing the input to the gate (pin 2) of FET 34 to be HI. Thus, in response to the gate of FET 34 being driven HI, FET 34 is switched on and the value at the source (pin 1) of FET 34 (ground) is passed to the drain (pin 3) of FET 34 (LO). Accordingly, the input at the gate (pin 1) of FET 36 is LO, causing FET 36 to be switched on, and causing the value at the source (pin 2) of FET 36 (the power supply VCC_MC_DB) to be passed to the drain (pin 3) of FET 36, thereby enabling the power supply interface 40 associated with the xD-type of media card 16.

Thus, embodiments of the present invention selectively enable/disable a power supply to a media card 16 in engagement with multi-card connector 20 of computer device 20 based on a type of media card 16 in engagement with multi-card connector 20. Accordingly, embodiments of the present invention isolate the power supply for a particular type of media card 16, thereby protecting the computer device 10 and/or media card 16 from a short condition that may otherwise result from the type of media card 16 inserted into card slot 14 (FIG. 1) and into engagement with multi-card connector 20.

What is claimed is:

1. A media power protection method, comprising:

detecting pin connections from a media card that is coupled to a multi-card connector, where the multi-card connector includes a plurality of connector pins;

determining a type of media card coupled to the multi-card connector from the detected pin connections; and controlling, at least one switch to enable connector pins of the multi-card connector that are used by the type of media card and to disable connector pins of the multi-card connector that are not used by the type of media card.

2. The method of claim 1, where disabling the connector pins of the multi-card connector that are not used by the type of media card includes disabling a power supply pin that is not a power supply for the type of media card.

3. The method of claim 1, wherein controlling the at least one switch comprises controlling at least one field effect transistor (FET) for selectively enabling the at least one power supply interface.

4. The method of claim 1, wherein controlling the at least one switch comprises selectively enabling a power supply to an xD media card power supply interface in response to detecting an absence of a MS media card.

5. The method of claim 1, wherein controlling the at least one switch comprises selectively enabling a power supply to an xD media card power supply interface in response to detecting an absence of a SD media card.

6. The method of claim 1, further comprising controlling, using the detect signal the at least one switch to selectively disable at least one power supply interface of the multi-card connector.

7. The method of claim 1, wherein controlling the at least one switch comprises disabling a power supply interface for a xD media card in response to detecting a MS media card coupled to the multi-card connector.

8. A media power protection system, comprising:

a computer comprising at least a processor and a memory;

a multi-card connector configured as a port in the computer, the multi-card connector comprising a plurality of connector pins;

a detection circuit for detecting pin connections from a media card that is coupled to the multi-card connector and determining a type of media card coupled to the multi-card connector from the detected pin connections; and a protection circuit configured to receive a detect signal from the detection circuit indicating the type of media card coupled to the multi-card connector, the protection circuit comprising at least one switch controllable by the detect signal to enable connector pins of the multi-card connector that are connected to the media card and to disable power supply pins of the multi-card connector not used by the type of media card.

9. The system of claim 8, wherein the at least one switch comprises at least one field effect transistor (FET) for selectively enabling the connector pins of the multi-card connector that are connected to the media card including at least one power supply interface.

10. The system of claim 8, wherein the at least one switch is controllable by the detect signal to selectively disable at least one power supply interface of the multi-card connector.

11. The system of claim 8, wherein the at least one switch is controllable by the detect signal to selectively disable at least one power supply interface associated with an extreme digital (xD) media card in response to the detect signal indicating at least one of a memory stick (MS) media card and a secure digital (SD) media card is coupled to the multi-card connector.

12. A media power protection system, comprising:

a computer device having a media card slot configured to receive a plurality of different types of media cards therein, the computer device having a multi-card connector disposed in the media card slot and configured with a plurality of connector pins to engage the plurality of different types of media cards, the computer device having at least one switch controllable by a detect signal indicating a type of media card by determining pins from the media card that are coupled to a combination of connector pins in the multi-card connector to selectively enable at least one of a plurality of power supply interfaces of the multi-card connector and to disable connector pins and power supply interfaces of the multi-card connector that are not used by the type of media card.

13. The system of claim 12, wherein the at least one switch comprises at least one field effect transistor (FET).

14. The system of claim 12, wherein the at least one switch is controllable by the detect signal to selectively disable at least one power supply interface of the multi-card connector.

15. A media power protection system, comprising:

a media controller configured to detect engagement of a media card with a multi-card connector, the multi-card connector having a plurality of pins where a combination of pins connected to pins of the media card are used for identifying a type of the media card engaged with the multi-card connector; and a power protection circuit configured to, in response to detecting an absence of engagement of the pins of the media card with at least one of the plurality of pins of the multi-card connector, disabling the pins of the multi-card connector not connected to the pins of the media card and selectively enable at least one power supply interface of the multi-card connector for providing power to the engaged media card based on the type of the media card.

16. The system of claim 15, wherein the power protection circuit comprises at least one field effect transistor (FET) for selectively enabling the at least one power supply interface.

17. The system of claim 15, wherein the power protection circuit is configured to selectively disable at least one power supply interface of the multi-card connector based on engagement of the media card with at least one of the plurality of pins.

* * * * *